US010687605B2

(12) United States Patent
Furstenburg

(10) Patent No.: US 10,687,605 B2
(45) Date of Patent: Jun. 23, 2020

(54) HYBRID HARD CASE AND SOFT CARRIER BACKPACK

(71) Applicant: Matthew Furstenburg, Crofton, MD (US)

(72) Inventor: Matthew Furstenburg, Crofton, MD (US)

( * ) Notice: Subject to any disclaimer, the term of this patent is extended or adjusted under 35 U.S.C. 154(b) by 0 days.

(21) Appl. No.: 16/031,239

(22) Filed: Jul. 10, 2018

(65) Prior Publication Data

US 2019/0008264 A1 Jan. 10, 2019

Related U.S. Application Data

(60) Provisional application No. 62/530,344, filed on Jul. 10, 2017.

(51) Int. Cl.

| | |
|---|---|
| ***A45F 3/04*** | (2006.01) |
| ***A45C 13/36*** | (2006.01) |
| *A45F 3/12* | (2006.01) |

(52) U.S. Cl.

CPC ..... *A45F 3/04* (2013.01); *A45C 13/36* (2013.01); *A45C 2200/20* (2013.01); *A45F 3/12* (2013.01); *A45F 2003/045* (2013.01); *A45F 2003/122* (2013.01); *A45F 2003/127* (2013.01); *A45F 2200/0583* (2013.01)

(58) Field of Classification Search

CPC .. A45F 3/04; A45F 3/042; A45F 3/047; A45F 3/06; A45F 2003/166; A45F 3/12; A45F 2003/122; A45F 2003/127; A45F 2003/045; A45F 2200/0583; A45C 13/02; A45C 2013/026; A45C 13/36; A45C 2200/20

USPC ..... 224/627–659

See application file for complete search history.

(56) References Cited

U.S. PATENT DOCUMENTS

| | | | | |
|---|---|---|---|---|
| 4,673,117 | A * | 6/1987 | Calton | A45C 11/20 224/148.3 |
| 5,445,276 | A * | 8/1995 | Gordon | A45C 11/20 206/545 |
| 5,579,966 | A | 12/1996 | Krumweide et al. | |
| 5,921,435 | A | 7/1999 | Billet | |
| 6,179,186 | B1 | 1/2001 | Blanking | |
| 6,216,926 | B1 | 4/2001 | Pratt | |
| 6,543,499 | B2 * | 4/2003 | McCreery | A45C 3/08 150/104 |

(Continued)

FOREIGN PATENT DOCUMENTS

| | | |
|---|---|---|
| CN | 105105500 | 12/2015 |
| WO | 97/37529 | 10/1996 |

*Primary Examiner* — Scott T McNurlen

(74) *Attorney, Agent, or Firm* — Whiteford, Taylor & Preston LLP; Gregory M. Stone

(57) ABSTRACT

A hybrid carrier, such as a backpack, is disclosed having a hard shell interior carrier and a soft outer carrier. The hard shell interior carrier has a body with an openable top. The shape of the body of the hard shell interior carrier and the inside shape of the soft outer carrier are complementary so that the hard shell interior carrier form fits into the inside of the soft outer carrier. The soft outer carrier includes attachment devices that are joined to attachment device receivers on the hard shell interior carrier to removably attach the hard shell interior carrier to the soft outer carrier. The soft outer carrier may include handles, backpack straps and/or waist straps for easy carrying.

16 Claims, 13 Drawing Sheets

(56) References Cited

U.S. PATENT DOCUMENTS

| | | | | |
|---|---|---|---|---|
| 7,669,436 | B2 * | 3/2010 | Mogil | A45C 11/20 62/457.7 |
| 7,673,777 | B2 | 3/2010 | Gleason, Jr. | |
| 8,118,201 | B1 | 2/2012 | Calkin | |
| 8,919,628 | B2 | 12/2014 | Jamlang | |
| D759,370 | S * | 6/2016 | Godzich | D3/216 |
| 2004/0206797 | A1 | 10/2004 | Kuhn | |
| 2009/0249700 | A1 * | 10/2009 | Peterson | A45F 3/08 52/2.17 |
| 2013/0221050 | A1 | 8/2013 | Murphy | |
| 2015/0223581 | A1 | 8/2015 | Boglione | |
| 2016/0113370 | A1 * | 4/2016 | Arel, Jr. | A45C 15/00 220/592.09 |

* cited by examiner

FIGURE 1
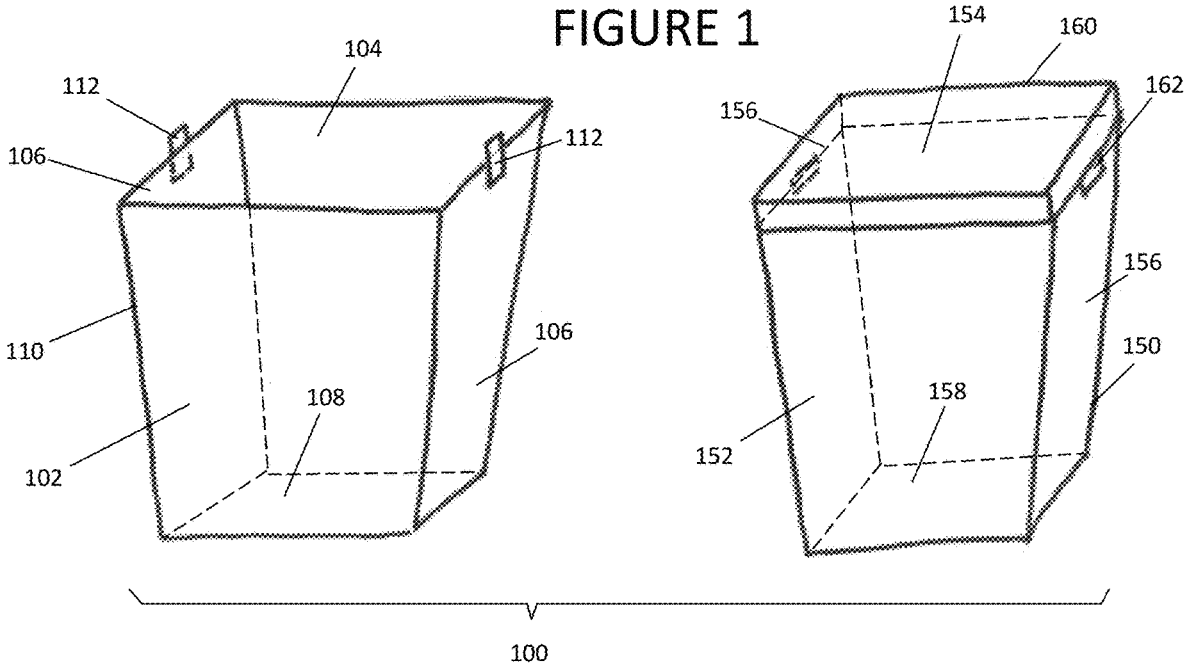
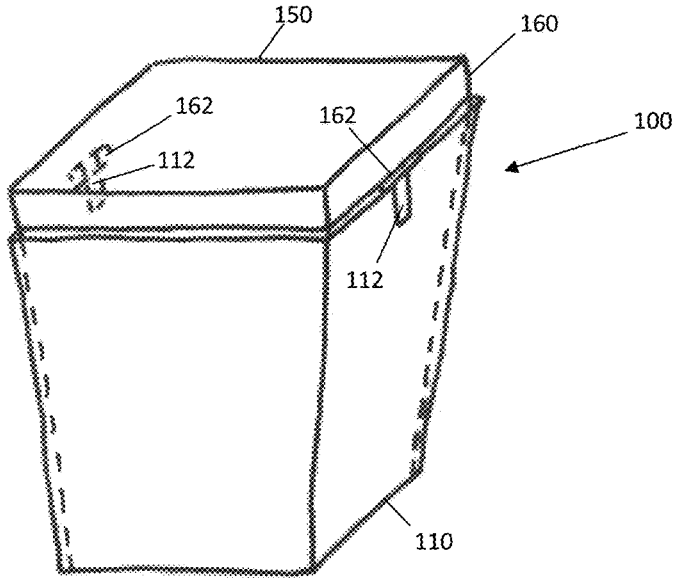
FIGURE 2

HYBRID HARD CASE AND SOFT CARRIER BACKPACK

CROSS REFERENCE TO RELATED APPLICATION

This application claims the benefit of U.S. Provisional Application No. 62/530,344 titled "Hybrid Hard Case/Soft Carrier Backpack," filed Jul. 10, 2017 by the inventor herein, which application is incorporated herein by reference in its entirety.

FIELD OF THE INVENTION

The present invention relates generally to backpacks and other personal carrying devices, and more particularly to a hybrid backpack including a hard shell interior case and a fitted soft carrier for the hard shell interior case.

BACKGROUND

Backpacks, suitcases, briefcases, purses, pocketbooks, satchels, and the like are frequently used to carry a wide variety of articles, including items such as laptop computers, books, folders, writing materials and implements, personal items, camping and hiking items, and a wide variety of other items. Such articles are typically placed into the carrier both for protection against the elements and for ease of carrying by the wearer. For instance, casual users of such carriers may wish to simply transport personal items, such as schoolbooks, during a workday, and may wish to ensure adequate space to carry the related essential items without overstuffing while still allowing easy access to items that might require quick access during their daily travels. Other users of such carriers may wish to similarly transport personal items during a more rugged hike or expedition, and may wish to not only ensure adequate storage space, but may likewise wish to ensure adequate protection for the contents, both from the possibility of damage from blunt force and from the elements. While a number of personal carriers have previously been provided, there remains a need in the art for personal carriers that can provide such protections while maintaining flexibility of use, ease of packing, and ready access to contents.

SUMMARY OF THE INVENTION

Disclosed herein is a combined or hybrid backpack having a rigid internal case that is preferably water and air tight, and a flexible outer case or sleeve. The rigid internal case has a body with an openable top and a gasket between the top and the body, which gasket may be seated in a groove formed in either the top or the body. The body and the top of the rigid internal case may preferably be closed in an air and water tight fashion by a hinge on one side and a latch on an opposite side, which latch is preferably permanently attached to the top and which latches over a matching feature formed in the body of the internal case according to known methods. The shape of the body of the internal case and the inside shape of the flexible outer sleeve are complementary so that the rigid internal case form-fits into the inside of the flexible outer case.

In accordance with certain aspects of an embodiment of the invention, a hybrid carrier is provided comprising: a hard shell interior carrier having a bottom wall, a front wall, a back wall opposite the top wall, two side walls extending between the front wall and the back wall, and an open top opposite the bottom wall; a soft outer carrier having an open interior sized to form fit about the bottom wall, the front wall, the back wall, and the side walls of the hard shell interior carrier; attachment devices on the soft outer carrier; and attachment device receivers on the hard shell interior carrier configured to receive the attachment devices to removably attach the soft outer carrier to the hard shell interior carrier; wherein the attachment devices are configured to pull the hard shell interior carrier into the open interior of the soft outer carrier so that the bottom wall of the hard shell interior carrier is in facing contact with the bottom wall of the soft outer carrier.

Still other aspects, features and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized. The present invention is illustrated by way of example, and not by way of limitation, in the figures of the accompanying drawings, in which like reference numerals refer to similar elements, and in which:

FIG. 1 is a schematic view of a soft outer carrier and hard shell interior carrier in accordance with certain aspects of an embodiment of the invention.

FIG. 2 is a schematic view of the hard shell interior carrier of FIG. 1 positioned in and joined to the soft outer carrier of FIG. 1.

DETAILED DESCRIPTION OF THE PREFERRED EMBODIMENTS

Figure 3:
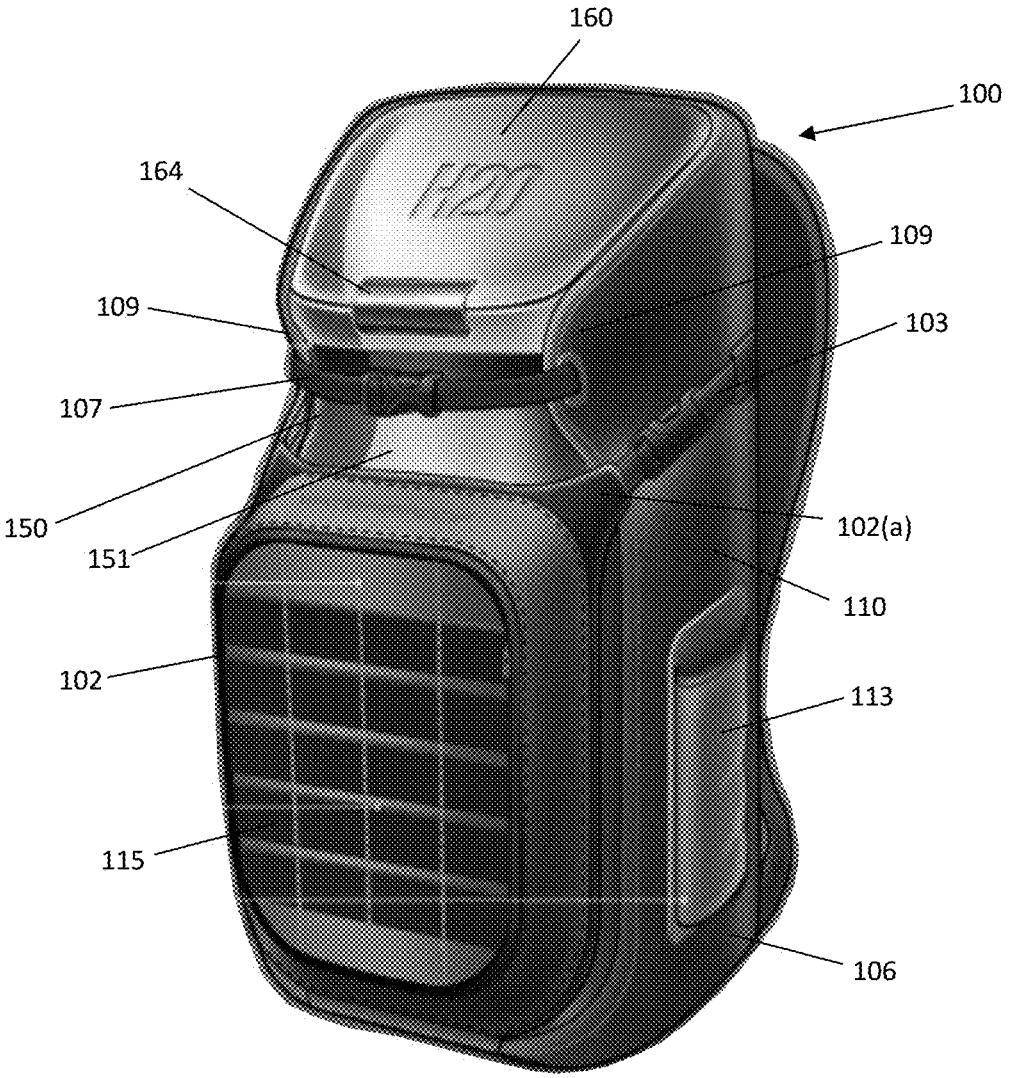
FIG. 3 is a perspective view of an exemplary hybrid carrier in accordance with certain aspects of a particular embodiment of the invention.

The following detailed description is provided to gain a comprehensive understanding of the methods, apparatuses and/or systems described herein. Various changes, modifications, and equivalents of the systems, apparatuses and/or methods described herein will suggest themselves to those of ordinary skill in the art.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

FIGS. 1 and 2 provide schematic views of a hybrid carrier (shown generally at 100), such as a backpack, in accordance with certain aspects of an embodiment of the invention. Hybrid carrier 100 includes a soft outer carrier 110, and a hard shell interior carrier 150 that is placed within, carried by, and removably attached to soft outer carrier 110. As used herein, the term "soft" when describing outer carrier 110 is intended to mean having a generally flexible structure, such as would be provided by a backpack formed of fabric, that does not hold its shape absent additional internal structure that expands the walls of the outer carrier towards its intended shape. Likewise, as used herein, the term "hard shell" when describing interior carrier 150 is intended to mean having a generally rigid structure capable of holding its intended shape in normal use, such as would be provided by a container formed of plastic, fiberglass, or similar materials.

Soft outer carrier 110 includes a front wall 102, a back wall 104, side walls 106, and bottom wall 108. Each of front wall 102, back wall 104, side walls 106, and bottom wall 108 has an interior side that faces an interior of soft outer carrier 100, and an exterior side that faces the exterior of soft outer carrier 110 (and the exterior of hybrid carrier 100). Likewise, hard shell interior carrier 150 includes a front wall 152, a back wall 154, side walls 156, and bottom wall 158. Each of front wall 152, a back wall 154, side walls 156, and bottom wall 158 has an interior side that faces an interior of hard shell interior carrier 150, and an exterior side that faces the respective interior sides of the walls of soft outer carrier 110. Moreover, the exterior side of each wall of hard shell interior carrier 150 is complementarily shaped to generally match the interior side of each wall of soft outer carrier 110, such that when hard shell interior carrier 150 is forcibly pushed into the interior of soft outer carrier 110, it pushes and expands each of front wall 102, back wall 104, side walls 106, and bottom wall 108 to their full dimensions, thus forming an integrated hybrid carrier 100 that includes a hard shell interior carrier 150 and a form-fit, soft outer carrier 110, providing security offered by the structural integrity of the hard shell carrier 110, with the flexibility and ease of adding straps, pockets, and other ancillary devices on the exterior through easy integration with the fabric or other flexible material of soft outer carrier 110.

With continued reference to FIGS. 1 and 2, hard shell interior carrier 150 also preferably includes a hard shell lid 160 that provides added protection to the contents held within hybrid carrier 100. In particular embodiments, hard shell lid 160 may be attached via a hinge to hard shell interior carrier 150, and may be closed by way of a latch, a snap-fit closure, or other closure device, examples of which are discussed in greater detail below. Likewise, in particular embodiments, hard shell lid 160 and/or the top of hard shell interior carrier 150 may be fitted with one or more gaskets, O-rings, or other seals that provide a waterproof, and optionally and air-tight, seal between hard shell interior carrier 150 and hard shell lid 160.

In order to both detachably connect hard shell interior carrier 150 to soft outer carrier 110, and to aid in form-fitting soft outer carrier 110 to the exterior of hard shell interior carrier 150, soft outer carrier 110 includes one or more attachment devices 112, preferably positioned on the sidewalls 106 of soft outer carrier 110. Likewise, hard shell interior carrier 150 includes one or more attachment device receivers 162 positioned to receive attachment devices 112. Attachment devices 112 and attachment device receivers 162 are configured to both detachably connect hard shell interior carrier 150 to soft outer carrier 110, and to cause the walls of hard shell interior carrier 150 to press against the corresponding walls of soft outer carrier 110 to expand soft outer carrier 110 to its maximum dimensions. More particularly, attachment devices engage attachment device receivers 162 so as to pull the top, open rim of hard shell interior carrier 150 downward into the interior of soft outer carrier 110. As both hard shell interior carrier 150 and soft outer carrier 110 are at least slightly tapered in width from top to bottom, pulling the top, open rim of hard shell interior carrier 150 downward into the interior of soft outer carrier 110 causes each of front wall 152, back wall 154, side walls 156, and bottom wall 158 to come into contact with and expand each corresponding wall of soft outer carrier 110 to provide a tightly fitter soft outer carrier 110 on hard shell interior carrier 150. Suitable attachment devices 112 and attachment device receivers 162 may include, for example, upwardly extending straps that loop through openings on at the top of the hard shell interior carrier 150 so as to pull the top rim of hard shell interior carrier 150 downward with respect to soft outer carrier 110, in turn pulling bottom wall 108 of soft outer carrier 110 against the bottom wall 158 of hard shell interior carrier 150. Similarly, attachment devices 112 may include horizontally mounted elastic strips positioned at the top of the outer sides of side walls 106 of soft outer carrier 110, which horizontally mounted elastic strips may engage hooks mounted at the top of the hard shell interior carrier 150 so as to pull the top rim of hard shell interior carrier 150 downward with respect to soft outer carrier 110, in turn pulling bottom wall 108 of soft outer carrier 110 against the bottom wall 158 of hard shell interior carrier 150. Those skilled in the art will recognize that other attachment and tightening mechanisms may be provided to meet such fitting purposes without departing from the spirit and scope of the invention.

Next, FIG. 3 is a perspective view of hybrid carrier 100 in accordance with certain aspects of an exemplary configuration, including soft outer carrier 110 and hard shell interior carrier 150. Hard shell lid 160 comprises a closable top that is preferably hinged at the back of hard shell lid 160 to hard shell interior carrier 150. Hard shell lid 160 may also have a manually operable latch 164 positioned at the front of hard shell lid 160 of traditional configuration that may hold hard shell lid 160 in the closed position shown in FIG. 3, while allowing a user to selectively open hard shell lid 160 when desired. As shown in FIG. 3, front wall 102 may be attached to bottom wall 108 along the bottom edge of front wall 102, and may optionally be detached from side walls 106 of soft outer carrier 102. Likewise, upper corners 102(*a*) of front wall 102 may receive straps 103 that may, for example, attach at an opposite end to side walls 106 or to back wall 104 of soft outer carrier 110. Thus, and as shown in FIG. 4, when straps 103 that secure front wall 102 are released, front wall 102 may be folded down so that hard shell interior container 150 may be slid laterally out of the inside of soft outer carrier 110.

Figure 4:
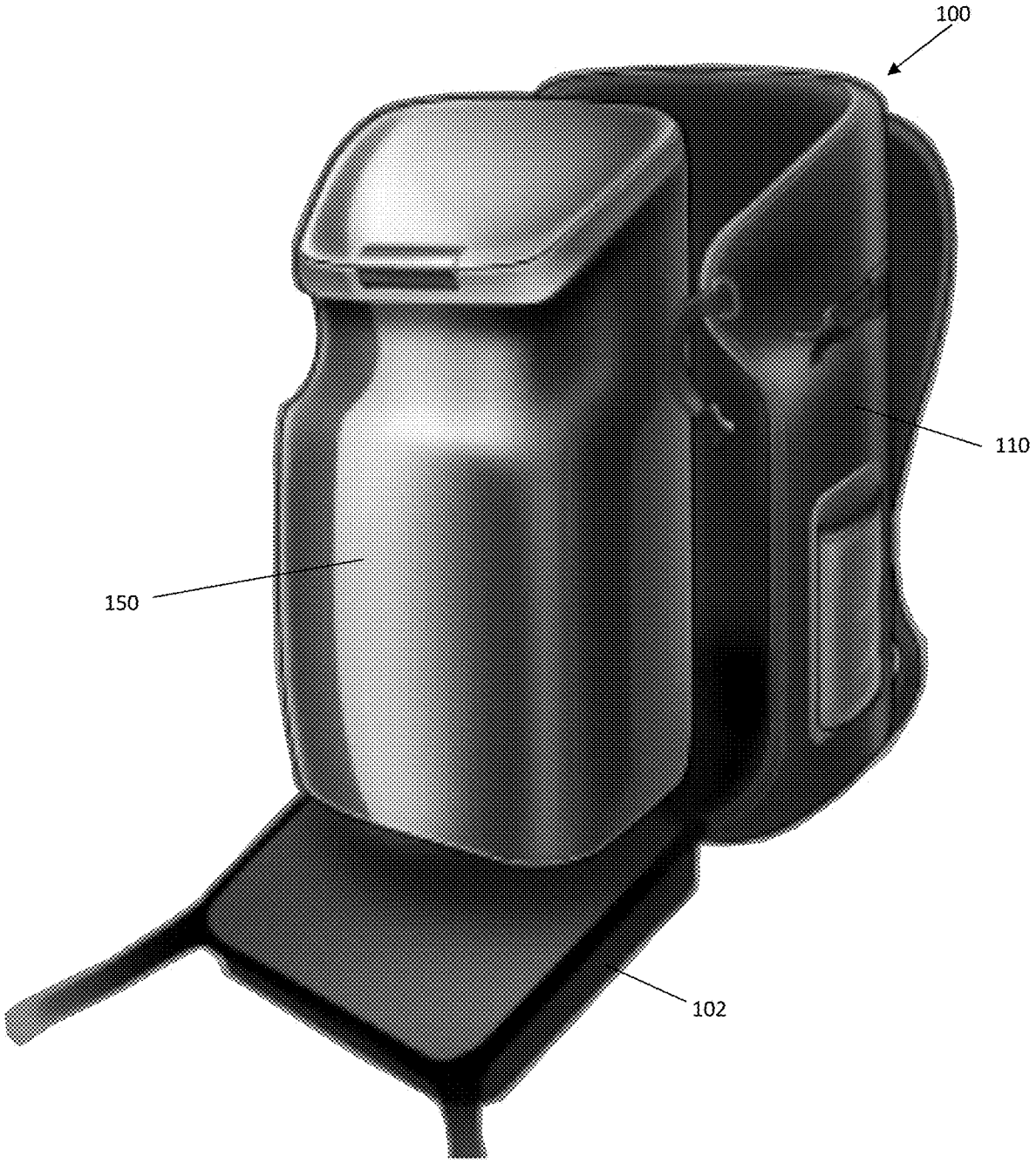
FIG. 4 is a perspective view of the hybrid carrier of FIG. 3 with the front wall of the soft outer carrier opened and the hard shell interior carrier moved laterally out of the soft outer carrier.

With continued reference to the exemplary configuration of FIGS. 3 and 4, hybrid carrier 100 may also include straps 107 that engage the top, front corners of each side wall 106, which straps 107 when connected help to secure the hard shell interior carrier 150 within soft outer carrier 110. As noted above, the exterior walls of hard shell interior carrier 150 are sized and shaped to match the interior of soft outer carrier 110 so that soft outer carrier 110 is form fit to hard shell interior carrier 150. More particularly, side walls 106 and back wall 104 of soft outer carrier 110 are sized and shaped to match the contours of hard shell interior carrier 150, which may have a concave portion 151 at the top of front wall 152 that extends into each side wall 156. Such concave portion 151 receives the top, front-most portions 109 of side walls 106 of soft outer carrier 110, pulling them inward (via strap 107) so that the front-most portions 109 of side walls 106 rest inward of the outermost edges of front wall 152 of hard shell interior carrier 150, in turn detachably joining soft outer carrier 110 to hard shell interior carrier 150 in a form fitting configuration.

Also as shown in FIGS. 3 and 4, side walls 106 of soft outer carrier 110 may include one or more pockets 103, and front wall 102 of soft outer carrier 110 may include one or more pockets 115, each of which may be shaped and dimensioned to carry various items, and may be open or closeable, such as by way of zippers, snap closures, hook-and-loop fasteners, or other such closing mechanisms as may be readily apparent to those skilled in the art. Further, front wall 102 of soft outer carrier 110 may also include straps for attaching various accessories, such as a molly strap arrangement of traditional configuration.

Figure 5:
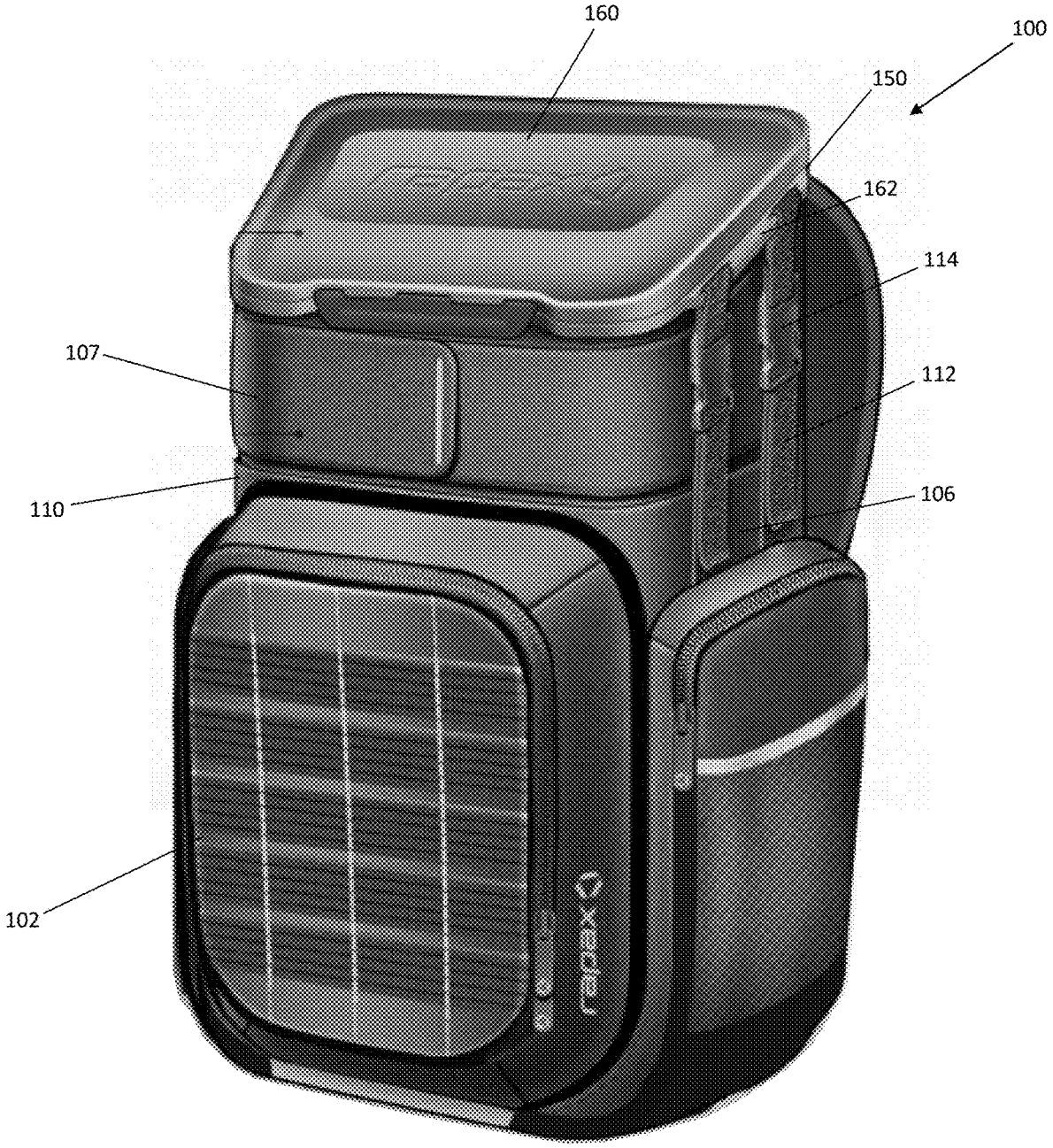
FIG. 5 is a perspective view of an exemplary hybrid carrier in accordance with further aspects of a particular embodiment of the invention.

Next, FIG. 5 is a perspective view of hybrid carrier 100 in accordance with further aspects of an exemplary configuration, including soft outer carrier 110 and hard shell interior carrier 150. As shown in the exemplary configuration of FIG. 5, front wall 102 of soft outer carrier 110 may be permanently joined along its side edges to side walls 106, such that soft outer carrier 110 forms a four-walled, open top and closed bottom carrier that receives hard shell interior carrier 150 via insertion through its open top. With reference to both FIGS. 5 and 6, straps 107 may optionally be formed integrally with the reset of soft outer carrier 110, and may be tightened around the top of hard shell interior carrier 150, engaging one another via cooperating strips of hook-and-loop fastening material at the front, top portion of hard shell interior carrier 150. The top edge of front wall 102 of soft outer carrier 110 may optionally terminate below the location at which straps 107 connect, so that the straps 107 are in direct contact with front wall 152 of hard shell interior carrier 150. Optionally, an interior surface of straps 107 may include a printed silicone pattern 107(*a*) in order to provide a firm, non-slip grip between straps 107 and hard shell interior carrier 150.

Figure 6:
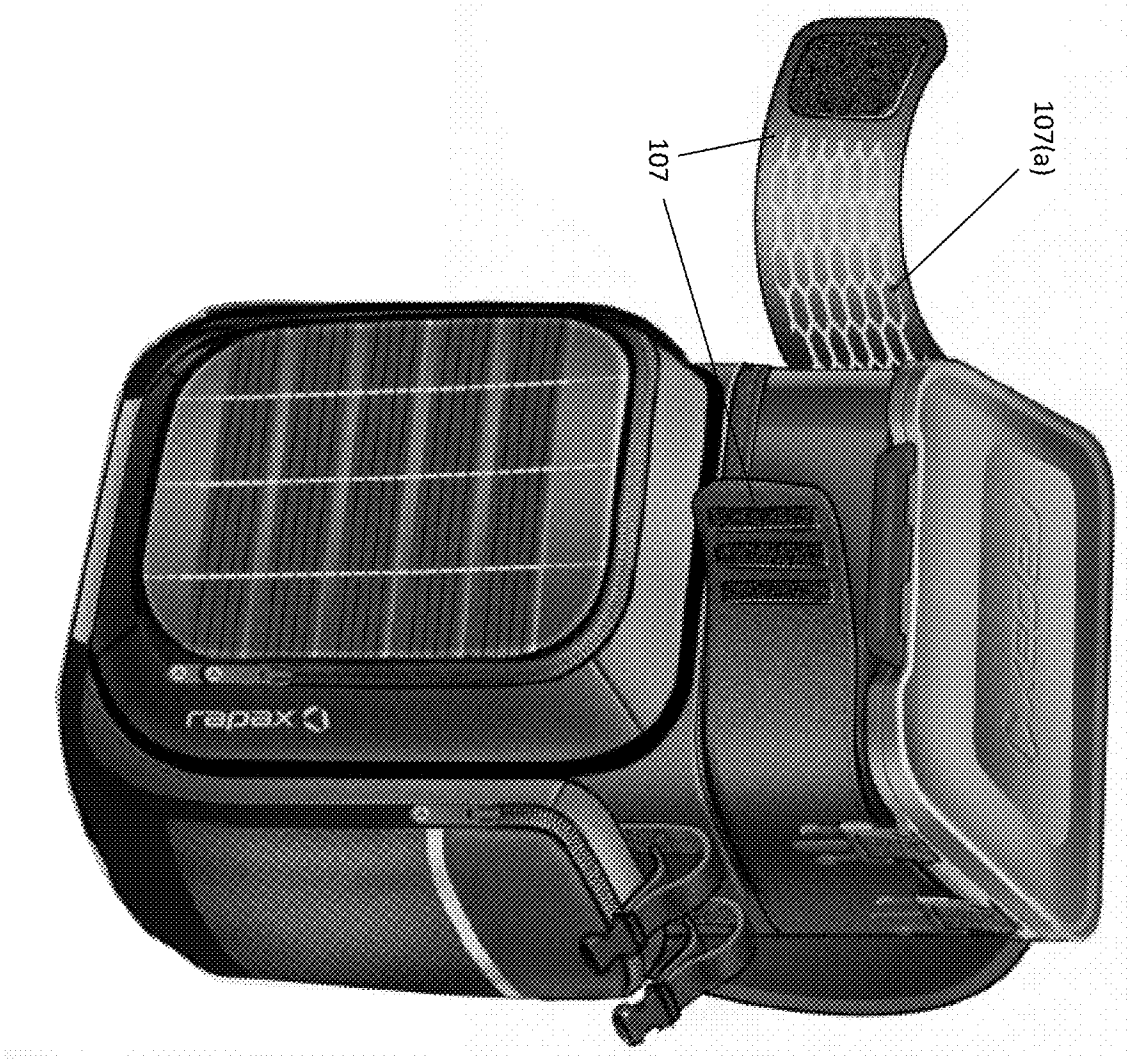
FIG. 6 is a perspective view of the hybrid carrier of FIG. 5 with front securing straps shown in an open position.

With continued reference to FIGS. 5 and 6, soft outer carrier 110 may be removably attached to hard shell interior carrier 150 in a form-fitted connection through attachment devices 112 on soft outer carrier 110 and attachment device receivers 162 on hard shell interior carrier 150. More particularly, attachment devices 112 may comprise vertical straps affixed to side walls 106 of soft outer carrier 110, and attachment device receivers 162 may comprise slots 162 formed in an outside perimeter of the top edge of hard shell interior carrier 150. In this exemplary configuration, straps 112 extend through slots 162, with straps 112 preferably segmented via a buckle connection 114 that, when detached, allows removal of hard shell interior carrier 150 from soft outer carrier 110. Further, straps 112 may be of adjustable length so as to tighten or loose the connection between soft outer carrier 110 and hard shell interior carrier 150, as desired. When buckle connections 114 are engaged and straps 112 are tightened, hard shell interior carrier 150 is pressed into soft outer carrier 110 in a form-fitting attachment, with complementary front, back, side, and bottom walls of each of soft outer carrier 110 and hard shell interior carrier 150 contacting each other. In accordance with the particular exemplary embodiment shown in FIGS. 5 and 6, two strap/buckle connections 114 may be provided on each side wall 106 of soft outer carrier 110.

Figure 7:
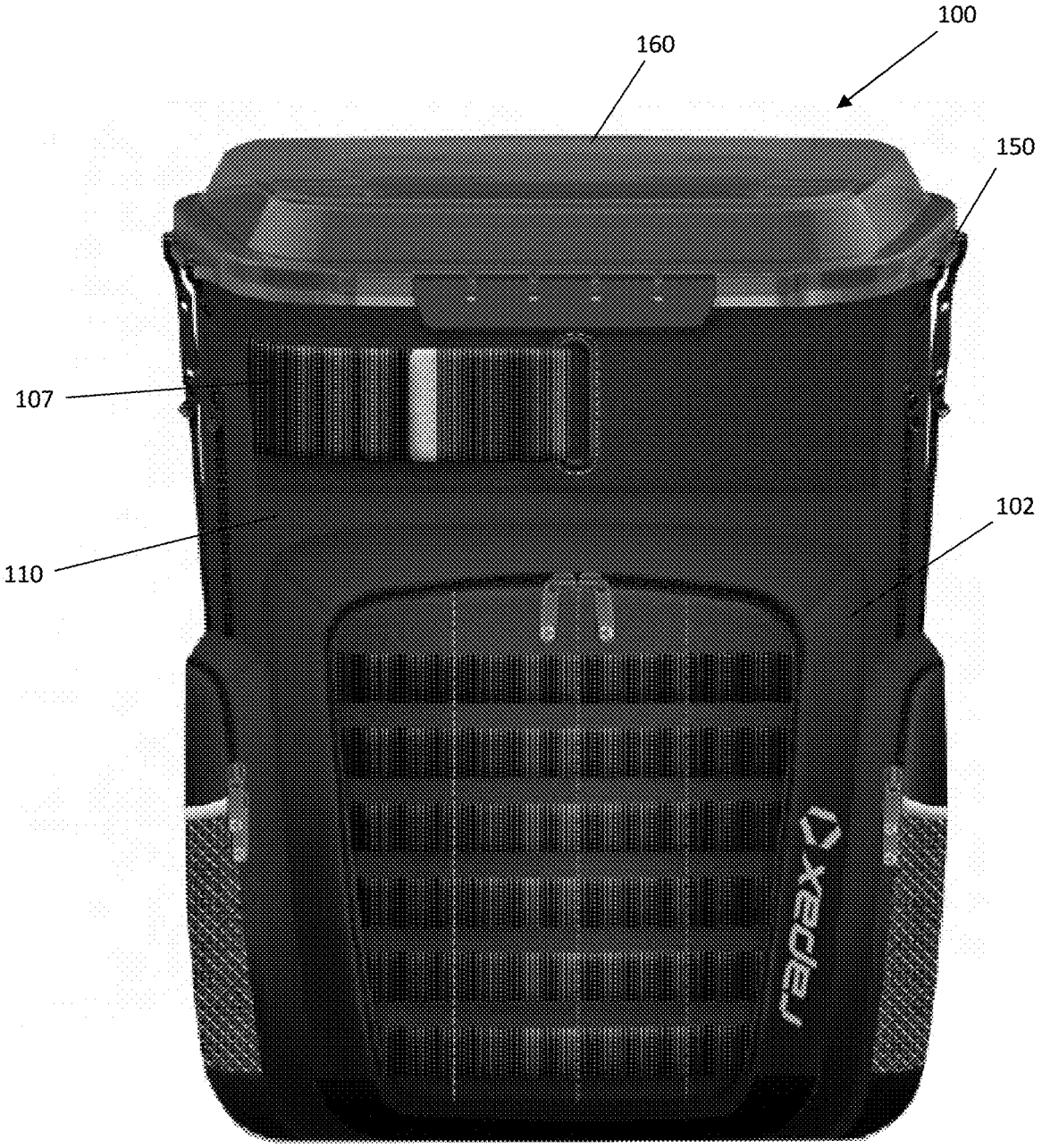
FIG. 7 is a front view of an exemplary hybrid carrier in accordance with further aspects of a particular embodiment of the invention.
Figure 8:
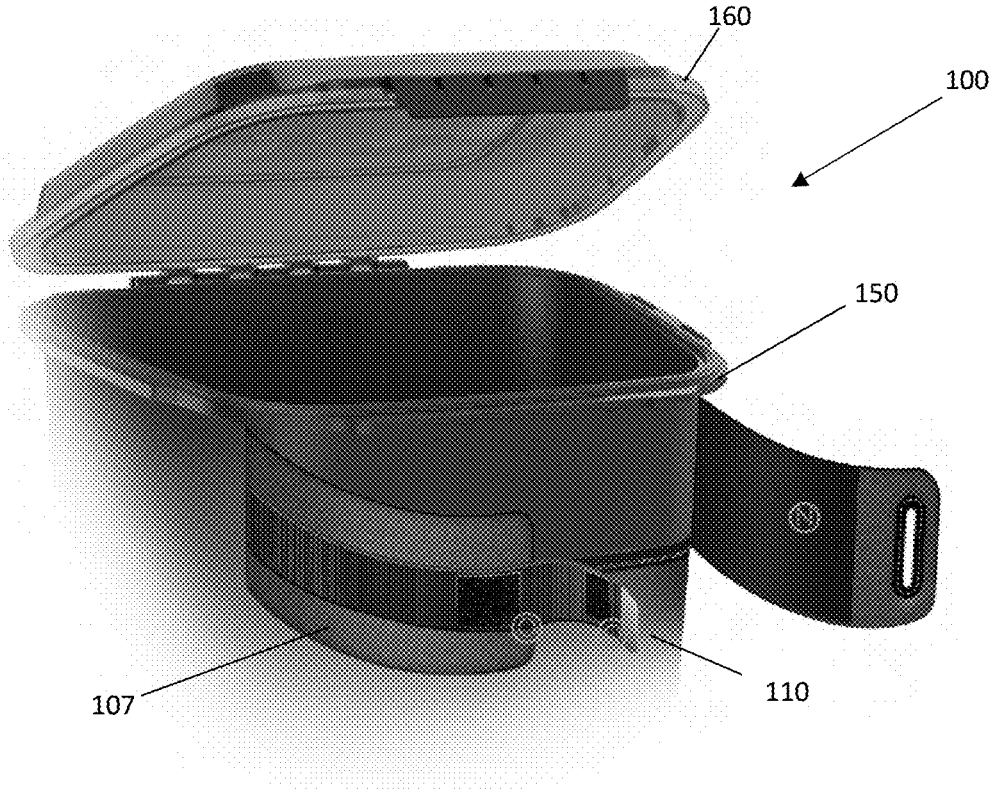
FIG. 8 is a partial perspective view of the hybrid carrier of FIG. 7 and showing details of a securing strap for securing soft outer carrier 110 to hard shell interior carrier 150.

Next, FIG. 7 is a perspective view of hybrid carrier 100 in accordance with further aspects of an exemplary configuration, including soft outer carrier 110 and hard shell interior carrier 150. As discussed above, straps 107 are provided and may be tightened around the top of hard shell interior carrier 150, engaging one another via cooperating strips of hook-and-loop fastening material at the front, top portion of hard shell interior carrier 150. Optionally, and with reference to both FIGS. 7 and 8, one or both of straps 107 may be attached to the top of hard shell interior carrier 150, such that when hard shell interior carrier 150 is placed inside of soft outer carrier 110, a portion of one of straps 107 may be fed through a corresponding slot in the front wall 102 of soft outer carrier 110. Straps 107 may then be connected to one another across the top of the front wall 152 of hard shell interior carrier 150 as shown in FIG. 7.

Figure 9:
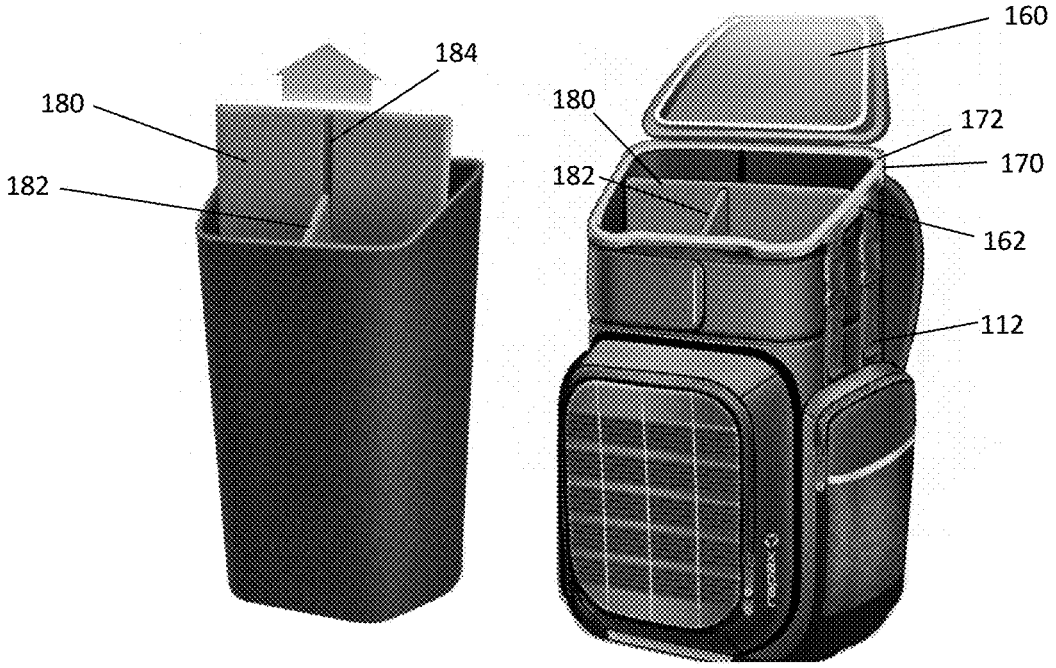
FIG. 9 is a perspective view of the hybrid carrier of FIG. 7 including internal divider panels.

Optionally and as shown in FIG. 9, hard shell interior carrier 150 may have a collar 170 extending around the top, open perimeter of hard shell interior carrier 150, which collar 170 mounts attachment device receivers 162. Likewise, collar 170 may include a channel that receives a gasket or other compressible member 172 that may be compressed upon closure of hard shell lid 160, which compressible member 172 may form a water-tight and optionally air-tight seal between hard shell lid 160 and the rest of the body of hard shell interior carrier 150. As collar 170 carries attachment device receivers 162, hard shell lid 160 may be opened and closed by a user without requiring removal of attachments devices 112. Also as shown in FIG. 9, a removable divider assembly 180 may optionally be provided to fit inside of hard shell interior carrier 150 to separate its contents. More particularly a divider wall 182 may be mounted to the interior face of front wall 152 of hard shell interior carrier 150, the interior vertical edge of which may engage a channel 184 on divider assembly 180 to allow divider assembly 180 to be slid into hard shell interior carrier 150 and held in place.

Figure 10:
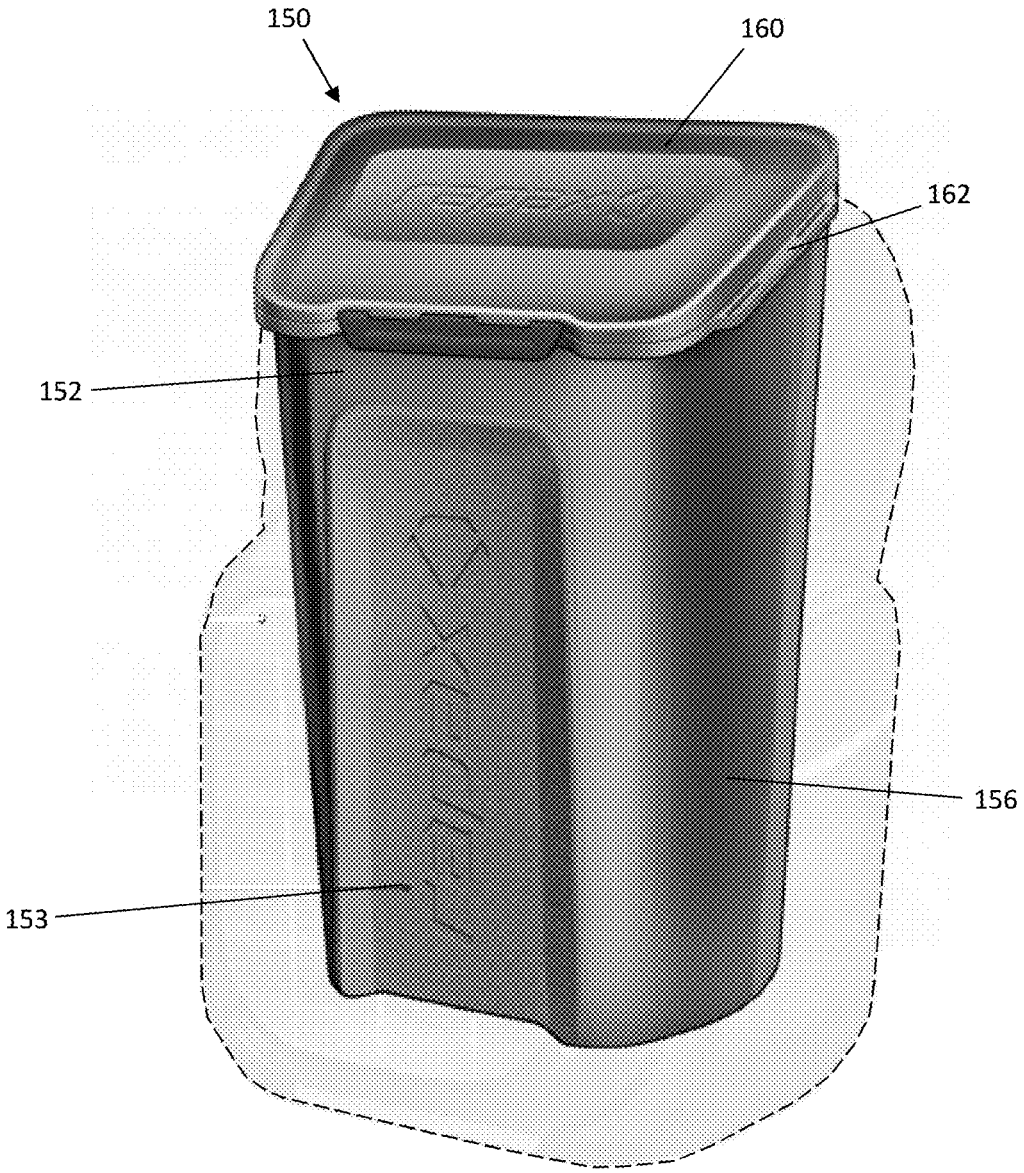
FIG. 10 is a perspective view of a hard shell interior carrier in accordance with further aspects of a particular embodiment of the invention.

FIG. 10 provides a perspective view of hard shell interior carrier 150 in accordance with certain aspects of an exemplary embodiment. As seen in FIG. 10, hard shell interior carrier 150 may be tapered in order to be easily inserted into and removed from a matching profile on the interior of soft outer carrier 110. Further, front wall 152 of hard shell interior carrier 150 may include a recess 153 that extends vertically up at least a portion of front wall 152. Recess 153 may provide a surface to receive branding or other indicia that may be displayed when hard shell interior carrier 150 is removed from soft outer carrier 110. Further, recess 153 may optimally be sized to match certain dimensions of an item that a user might carry in pocket 115 on front wall 102 of soft outer carrier 110. By way of non-limiting example, recess 153 may be sized to receive the width of a laptop or tablet computer that is positioned within pocket 115 on front wall 102, thus reducing the tendency of such sensitive electronic equipment from moving about on the interior of pocket 115 when hybrid carrier 100 is being transported.

Figure 11:
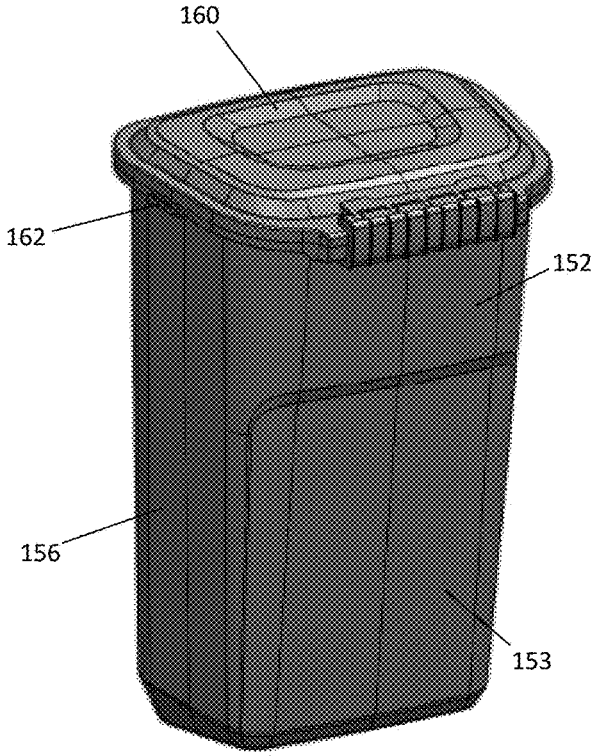
FIG. 11 is a perspective view of a hard shell interior carrier in accordance with still further aspects of a particular embodiment of the invention.
Figure 12:
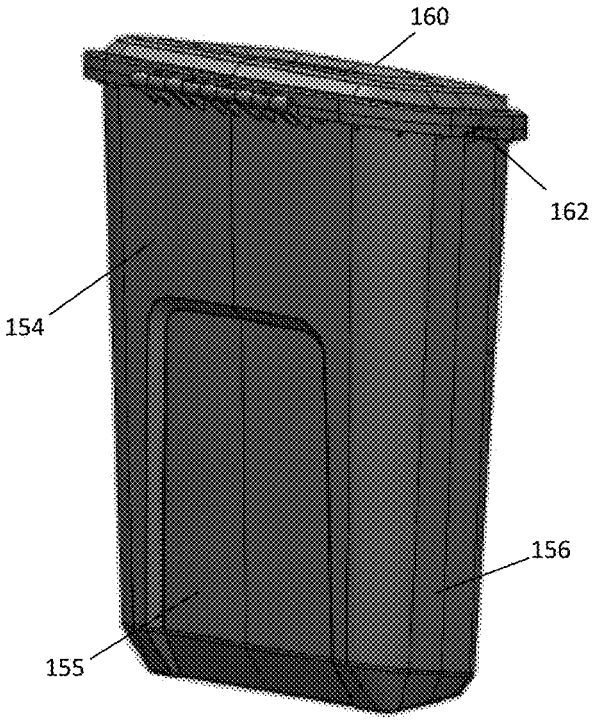
FIG. 12 is another perspective view of the hard shell interior carrier of FIG. 11.

FIGS. 11 and 12 provide perspective views of hard shell interior carrier 150 in accordance with still further aspects of an exemplary embodiment. As shown in FIG. 11, recess 153 may alternatively extend the entire width of front wall 152. Likewise, the bottom of each of front wall 152, side walls 156, and back wall 154 may optimally angle inward as they approach bottom wall 158 of hard shell interior carrier 150, thus allowing greater nesting and tighter form fitting of hard shell interior carrier 150 within soft outer carrier 110. Similarly, back wall 154 of hard shell interior carrier 150 may include a back wall recess 155 that extends vertically up at least a portion of back wall 154. Recess 155 may optimally be sized to match certain dimension of an item that a user might carry in back wall 104 of soft outer carrier 110, as discussed in greater detail below with respect to FIG. 14.

Figure 13:
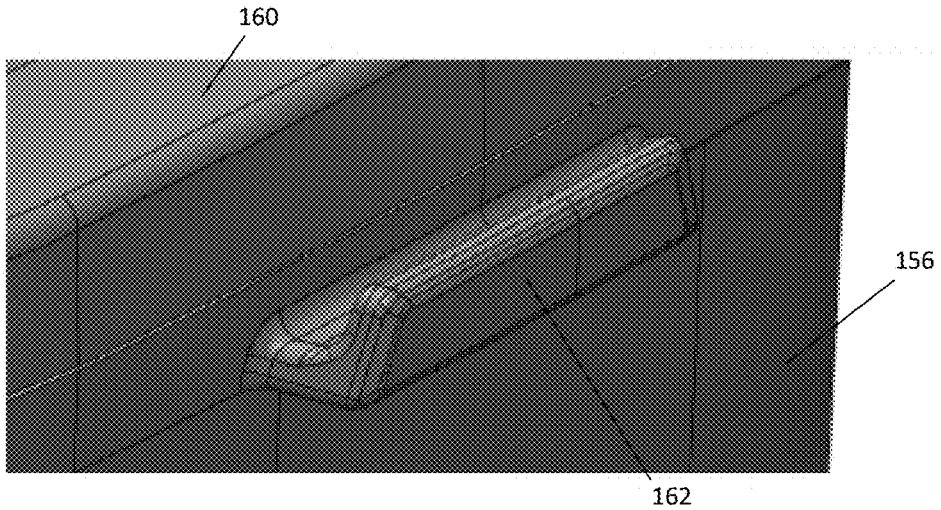
FIG. 13 is a close-up view of an attachment device receiver on the hard shall interior carrier of FIGS. 11 and 12.

As shown in FIGS. 11 and 12 and the close-up view of FIG. 13, attachment device receivers 162 may optionally comprise upwardly extending hooks at the upper edge of side walls 156 of hard shell interior carrier 150. As discussed in greater detail below, hooks 162 may receive and hold attachment devices 112 in the form of a horizontally mounted elastic band at the top of each side wall 106 of soft outer carrier 110 to both removably join soft outer carrier 110 to hard shell interior carrier 150 and to provide a tight, form-fitting connection between them.

Figure 14:
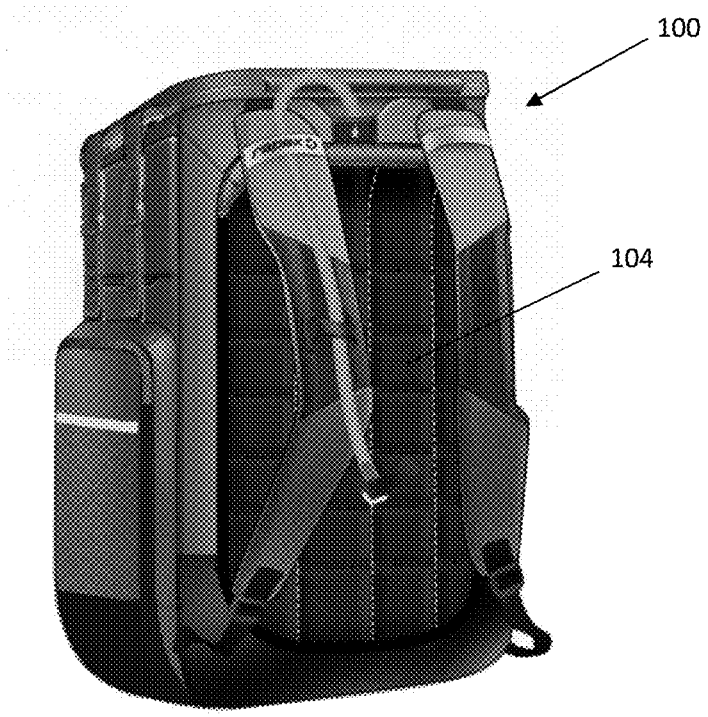
FIG. 14 is a rear perspective view of the hybrid carrier of FIG. 7 including a camelback pouch in accordance with further aspects of a particular embodiment of the invention.
Figure 15:
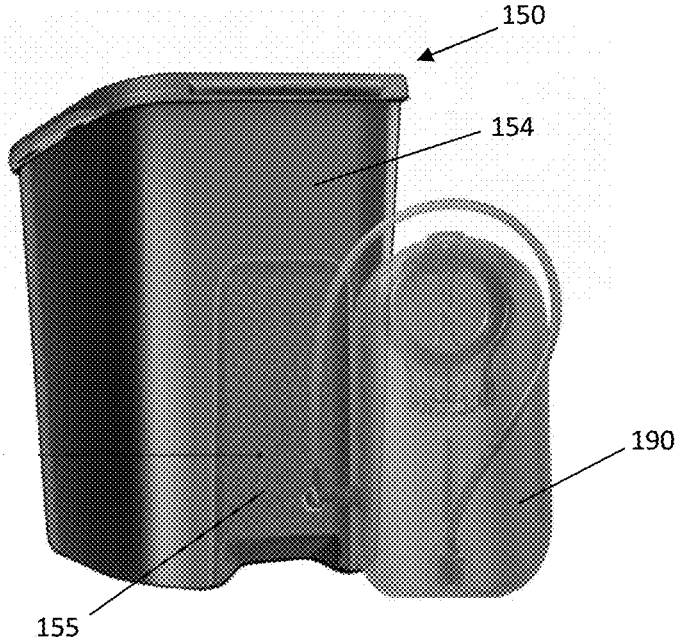
FIG. 15 is a rear perspective view of a hard shell interior carrier of the hybrid carrier of FIG. 7, the interior carrier having a recess formed therein to accommodate a portion of the volume of a camelback pouch.

Next, as shown in FIGS. 14 and 15, back wall 154 of hard shell interior carrier 150 preferably includes recess 155 to accommodate at least a portion of the volume of a camelback drinking container 190. Back wall 104 of soft outer carrier 110 may include a pouch that receives camelback drinking container 190 and positions it to align with recess 155 of hard shell carrier 150. Optionally, such pouch may position camelback drinking container 190 in direct contact with recess 155 of hard shall carrier 150.

Figure 16:
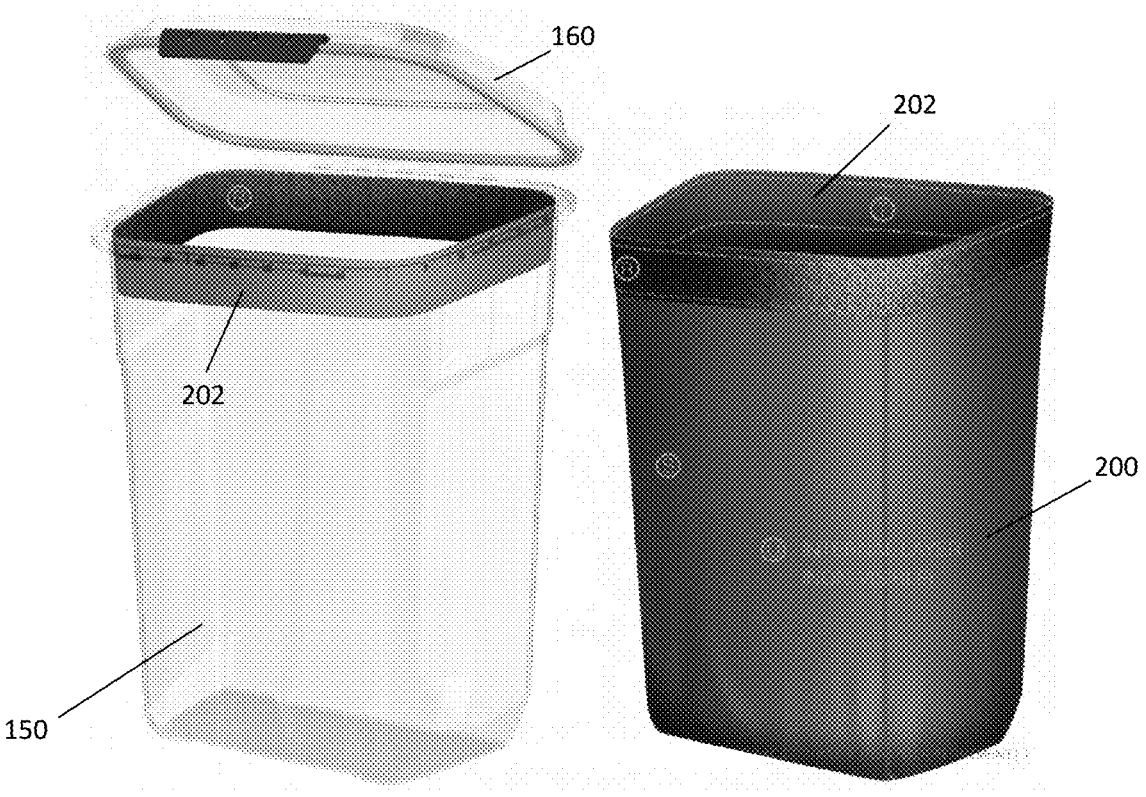
FIG. 16 is a perspective view of a flexible liner for use with the hard shell interior carrier of the hybrid carrier of FIG. 7.

Optionally, and as shown in FIG. 16, hard shell interior carrier 150 may be fitted with a removable, flexible sleeve 200 that may be removably positioned within hard shell interior carrier 150. To facility such removable connection, mating sections 202 of hook-and-loop fastening material may be provided along the upper, outer perimeter of flexible sleeve 200 and the upper, interior perimeter of hard shell interior carrier 150.

Figure 17:
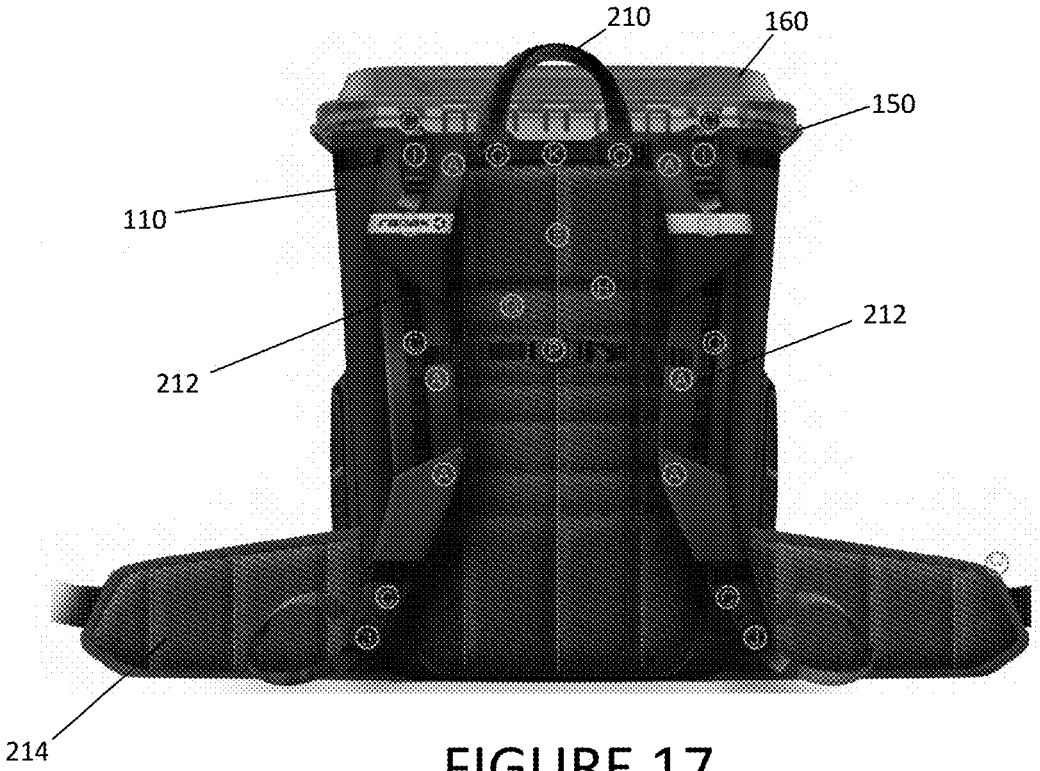
FIG. 17 is a rear view of the hybrid carrier of FIG. 7 in accordance with further aspects of an embodiment of the invention.

Likewise, in order to facilitate use of hybrid carrier 100 as a backpack or similarly transportable carrier, and with particular reference to FIG. 17, various devices may be included on hybrid carrier 100 to make carrying hybrid carrier 100 more convenient. Specifically, soft outer carrier 110 may include one or more handles 210, backpack straps 212 positioned to go over a wearer's shoulders, and a waist strap 214 positioned to wrap around a wearer's waist when hybrid carrier 100 is positioned on the wearer's back.

Figure 18:
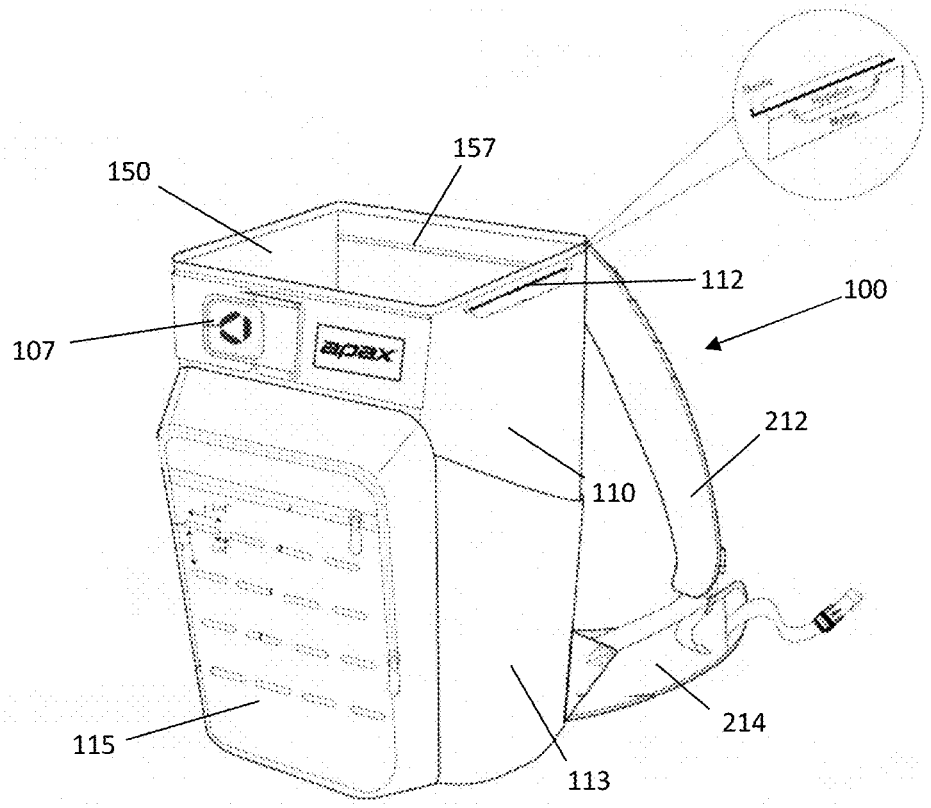
FIG. 18 is a perspective view of an hybrid carrier in accordance with further aspects of a particularly preferred embodiment of the invention.
Figure 19:
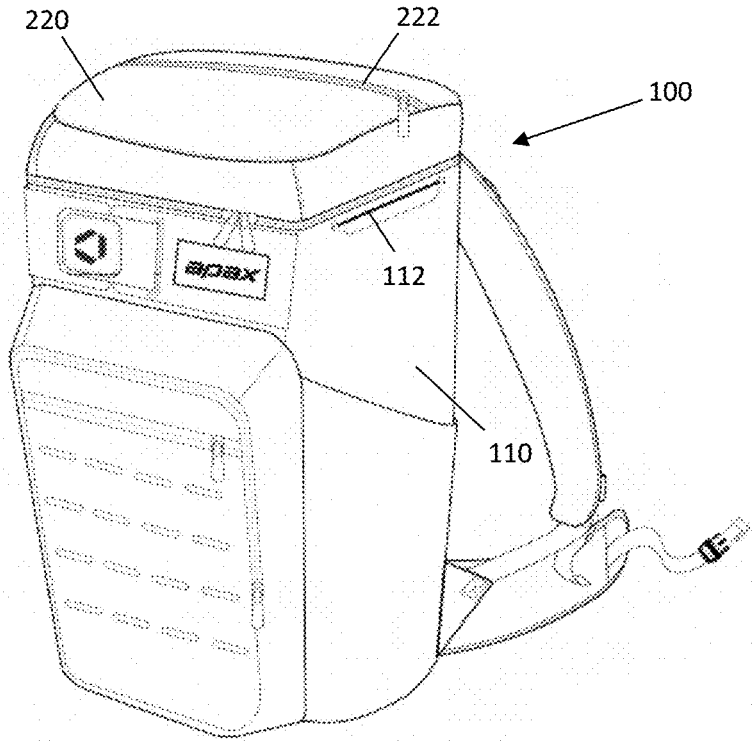
FIG. 19 is a perspective view of the hybrid carrier of FIG. 18 including a removable cover for the soft outer carrier.

FIGS. 18-21 show various aspects of a hybrid carrier 100 in accordance with certain aspects of a particularly preferred embodiment. With particular reference to FIGS. 18 and 19, attachment device 112 may comprise a horizontal, elastic band that extends horizontally a short distance below the top, open edge of soft outer carrier 110 on the outer face of each side wall 106 of soft outer carrier 110. The elastic band is preferably tacked or otherwise affixed at its ends to soft outer carrier 110 at a location within the width of side wall 106, such that the entirety of each elastic strip does not extend past the vertical edges of each side wall 106. Each elastic band may be stretched upward to overlap hooks 162 on hard shell interior carrier 150, causing those elastic bands to pull hard shell interior carrier 150 downward into soft outer carrier 110 so that the bottom wall 158 of hard shell interior carrier 150 presses against the bottom wall 108 of soft outer carrier 110 and generally expands soft outer carrier 110 to its fully expanded configuration. As shown in FIG. 19, soft outer carrier 110 of hybrid carrier 100 may include a soft outer carrier lid 220 that may be removably attached to soft outer carrier 110 with hard shell interior carrier 150 positioned inside of soft outer carrier 110. Soft outer carrier lid 220 may be removably attached to soft outer carrier 110 with zippers, as shown in FIG. 19, or with such other temporary fastening devices as will readily occur to those skilled in the art. Further, soft outer carrier lid 220 may optionally be provide one or more pockets 222 providing additional storage options. Optionally, interior pocket 157 may be provided on the interior of hard shell interior carrier 150, which interior pocket 157 is sized to receive soft outer carrier lid 220 after it has been removed from soft outer carrier 110.

Figure 20:
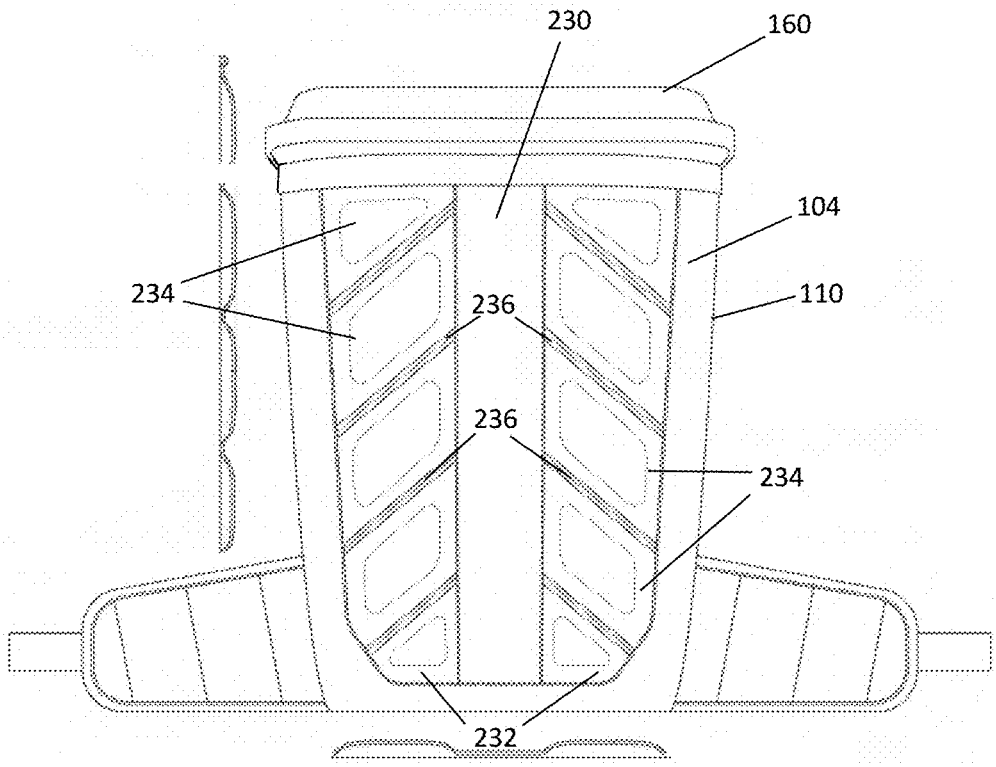
FIG. 20 is a rear view of the hybrid carrier of FIG. 20.
Figure 21:
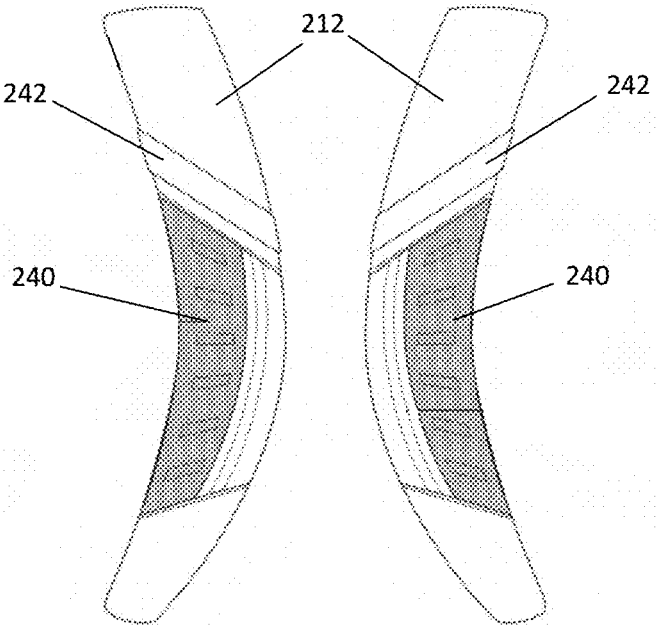
FIG. 21 is close-up view of the backpack straps of the hybrid carrier of FIG. 18.

As shown in FIG. 20, hybrid carrier 100 may include compression molded padding along back wall 104 of soft outer carrier 110. Such compression molded padding preferably defines a central, vertical spine relief channel 230 that positions hybrid carrier 100 away from the wearer's spine, and padded side panels 232 that provide cushioning between hard shell interior carrier 150 and the side portions of the wearer's back. Each padded side panel includes separate cushion segments 234 that are separated by depressed channels 236 that angle downward from spine relief channel 230 to the outer edges of padded side panels 232. Channels 236 are configured to allow water and/or sweat to wick away from the wearer's back. Further, and with reference to FIG. 21, backpack straps 212 may include sections 240 of die-cut closed cell foam encased in quick drying mesh to provide for quick drying of straps 212, and webbing 242 to receive tubing (e.g., a drinking supply hose) from camelback container 190 when positioned in soft outer carrier 110.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A hybrid carrier comprising:

a hard shell interior carrier having a bottom wall, a front wall, a back wall opposite said front wall, two side walls extending between said front wall and said back wall, and an open top opposite said bottom wall, and a collar extending around said open top, wherein said bottom wall, said front wall, said back wall, and said two side walls are unitarily formed of rigid plastic or fiberglass;

a soft outer carrier having an open interior sized to form fit about said bottom wall, said front wall, said back wall, and said side walls of said hard shell interior carrier;

attachment devices on said soft outer carrier; and attachment device receivers on said hard shell interior carrier configured to receive said attachment devices to removably attach said soft outer carrier to said hard shell interior carrier;

wherein said attachment devices are configured to pull said hard shell interior carrier into said open interior of said soft outer carrier so that said bottom wall of said hard shell interior carrier is in facing contact with said bottom wall of said soft outer carrier; and wherein said attachment device receivers are positioned on an outer edge of said collar opposite said open top.

2. The hybrid carrier of claim 1, further comprising an openable, rigid cover movably attached to said open top of said hard shell interior carrier.

3. The hybrid carrier of claim 2, further comprising a soft outer carrier lid removably attached to an open top of said soft outer carrier.

4. The hybrid carrier of claim 3, further comprising a pocket on an interior wall of said hard shell interior carrier, wherein said pocket is sized to receive said soft outer carrier lid.

5. The hybrid carrier of claim 2, wherein said openable, rigid cover is positioned with respect to said attachment device receivers so as to allow opening and closing of said openable, rigid cover without removal of said attachment devices from said attachment device receivers.

6. The hybrid carrier of claim 1, wherein said attachment devices on said soft outer carrier further comprise horizontally mounted elastic bands adjacent a top edge of each one of a pair of opposing side walls of said soft outer carrier.

7. The hybrid carrier of claim 6, wherein said attachment device receivers further comprise upwardly extending hooks adjacent a top edge of each of said side walls of said hard shell interior carrier.

8. The hybrid carrier of claim 1, wherein said attachment devices on said soft outer carrier further comprise at least one length-adjustable vertical strap affixed to each one of a pair of opposing side walls of said soft outer carrier.

9. The hybrid carrier of claim 8, wherein said attachment device receivers further comprise slots formed in an outside perimeter of a top edge of said hard shell interior carrier.

10. The hybrid carrier of claim 1, said soft outer carrier further comprising:

an outer carrier bottom wall, an outer carrier front wall, an outer carrier back wall opposite said outer carrier front wall, two outer carrier side walls extending between said outer carrier front wall and said outer carrier back wall, and an open top opposite said bottom wall;

a pocket on said outer carrier front wall;

a plurality of horizontal strap segments positioned to extend across said front wall of said hard shell interior carrier between said pocket on said outer carrier front wall and said open top of said hard shell interior carrier;

wherein said plurality of horizontal strap segments are configured to removably engage one another to circumferentially tighten said soft outer carrier about said hard shell interior carrier.

11. The hybrid carrier of claim 1, said soft outer carrier further comprising an outer carrier back wall sized for facing engagement with said back wall of said hard shell interior carrier, and a pocket formed in said outer carrier back wall configured to removably receive a portable fluid container.

12. The hybrid carrier of claim 1, further comprising a removable liner removably mounted within said hard shell interior carrier.

13. The hybrid carrier of claim 12, wherein said removable liner further comprises a first portion of hook-and-loop fastening material extending around an outer circumference of said removable liner adjacent a top edge of said removable liner, and said hard shell interior carrier further comprises a second portion of hook-and-loop fastening material extending around an interior circumference of said hard shell interior carrier adjacent said open top of said hard shell interior carrier.

14. The hybrid carrier of claim 1, said soft outer carrier further comprising an outer carrier back wall sized for facing engagement with said back wall of said hard shell interior carrier, and padded panels positioned to provide cushioning between said hard shell interior carrier and a wearer's back, each said padded panel comprising a plurality of cushion segments that are separated by depressed channels, wherein said depressed channels angle downward from an inner end of each said channel to an outer edge of each said channel.

15. The hybrid carrier of claim 14, further comprising a vertical, depressed spine relief channel extending between said padded panels.

16. The hybrid carrier of claim 1, wherein said attachment devices further comprise segmented straps, each said segmented strap further comprising:

a first segment affixed at a first end of said first segment to an exterior of said soft outer carrier, and having a first buckle connector at a second end of said first segment; and a second segment configured to engage said attachment device receivers at a first end of said second segment, and having a second buckle connector configured for releasable attachment to said first buckle connector at a second end of said second segment.

* * * * *